US011345508B2

(12) United States Patent
Wisecarver et al.

(10) Patent No.: US 11,345,508 B2
(45) Date of Patent: May 31, 2022

(54) LEAK PROOF CONTAINER WITH PUSH LOCK BODY AND ROLLOVER HINGE

(71) Applicant: INTERNATIONAL PAPER COMPANY, Memphis, TN (US)

(72) Inventors: Mark Anthony Wisecarver, Morristown, TN (US); James William Sloan, II, Edgefield, SC (US); Kenneth Calvin Hyatt, Springdale, AR (US); Jade Kiara Housewirth, Richmond, VA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/896,940

(22) Filed: Jun. 9, 2020

(65) Prior Publication Data

US 2021/0078758 A1 Mar. 18, 2021

Related U.S. Application Data

(63) Continuation-in-part of application No. 16/572,809, filed on Sep. 17, 2019, now Pat. No. 11,292,633.

(51) Int. Cl.

| | |
|---|---|
| ***B65D 5/42*** | (2006.01) |
| ***B65D 5/30*** | (2006.01) |
| ***B65D 5/24*** | (2006.01) |
| ***B31B 50/26*** | (2017.01) |

(52) U.S. Cl.

CPC ..... *B65D 5/4279* (2013.01); *B31B 50/26* (2017.08); *B65D 5/244* (2013.01); *B65D 5/301* (2013.01)

(58) Field of Classification Search

CPC ..... B65D 5/4279; B65D 5/244; B65D 5/28; B65D 5/4266; B65D 5/248

USPC ..... 229/190, 186, 171, 5.84, 132, 122.32, 229/180

See application file for complete search history.

(56) References Cited

U.S. PATENT DOCUMENTS

| | | | | |
|---|---|---|---|---|
| 2,443,431 | A | 6/1948 | Ringler | |
| 2,588,455 | A | 3/1952 | Adams | |
| 2,859,906 | A | 11/1958 | Reynolds | |
| 2,909,105 | A | 10/1959 | Lawrence | |
| 3,008,626 | A | 11/1961 | Lawrence | |
| 3,102,674 | A * | 9/1963 | Portola | B65D 5/48048 229/117.21 |
| 3,511,429 | A | 5/1970 | Brian | |

(Continued)

*Primary Examiner* — Christopher R Demeree
(74) *Attorney, Agent, or Firm* — Michael D. Folkerts; Thomas W. Ryan

(57) ABSTRACT

A leak proof container and a method of forming the container from a blank. The blank includes a bottom panel, first and second side panels at opposing lateral edges of the blank, and opposing end portions located at opposing longitudinal ends of the blank. Each end portion includes an inner end panel, an outer end panel hingedly connected to the inner end panel at hinge portions, and first and second corner panels, each corner panel forming a gusset between one of the side panels and the inner end panel, each gusset including a notch area for receiving one of the hinge portions. First and second locking tabs are defined in the outer end panel. The outer end panel can be folded over the inner end panel to position the hinge portions in the notch areas, and the locking tabs can be positioned between the gussets and the inner end panel.

18 Claims, 6 Drawing Sheets

(56) References Cited

U.S. PATENT DOCUMENTS

| | | | | | |
|---|---|---|---|---|---|
| 3,670,881 | A | | 6/1972 | Dutcher | |
| 3,904,106 | A | | 9/1975 | Elder | |
| 4,214,695 | A | | 7/1980 | Cooper | |
| 4,306,658 | A | | 12/1981 | Montealegre | |
| 4,340,169 | A | * | 7/1982 | Webinger | B65D 5/0005 229/101 |
| 4,531,669 | A | * | 7/1985 | Osborne | B65D 5/685 229/117.07 |
| 4,930,639 | A | | 6/1990 | Rigby | |
| 5,217,159 | A | | 6/1993 | Calvert | |
| 5,358,176 | A | * | 10/1994 | Rigby | B65D 5/5455 229/227 |
| 5,411,204 | A | | 5/1995 | DeMay | |
| 5,415,340 | A | | 5/1995 | Calvert | |
| 5,638,978 | A | | 6/1997 | Cadiente | |
| 6,186,931 | B1 | * | 2/2001 | Calvert | B31B 50/006 493/8 |
| 8,567,661 | B2 | * | 10/2013 | Sullivan | B65D 5/48048 229/120.24 |
| 9,216,837 | B2 | * | 12/2015 | Hubbard | B65D 5/2047 |
| 10,577,145 | B2 | | 3/2020 | Bevier | |
| 2016/0001917 | A1 | | 1/2016 | Gould | |

* cited by examiner

LEAK PROOF CONTAINER WITH PUSH LOCK BODY AND ROLLOVER HINGE

RELATED APPLICATIONS

This application is a continuation-in-part of U.S. patent application Ser. No. 16/572,809, filed Sep. 17, 2019, and entitled "LEAK PROOF CONTAINER WITH PUSH LOCK BODY," the entire disclosure of which is incorporated herein by reference.

FIELD OF THE INVENTION

The present disclosure relates to containers or trays formed from a blank of material and, more particularly, to a container that is formed with a leak proof construction for retaining moisture or fluid within the container.

BACKGROUND OF THE INVENTION

In some applications of containers or trays formed of folded material such as paperboard material, e.g., corrugated paperboard, the container or tray may be configured to receive products having moisture or a fluid content that can leak into a base portion of the container or tray. In a known use of a container, a package containing protein parts of poultry may be supported within the container and the container can prevent leakage of fluids outside of the container.

For example, one known type of container can be formed from a blank of corrugated material wherein a bottom panel and a plurality of side panels may be formed of a unitary construction from a die cut and scored sheet of material. It is also known to provide such a container construction wherein the corners adjacent to the bottom are sealed. In such a container construction, the side panels can be integrally connected to the bottom panel along respective fold lines, and adjacent side panels can be connected by a folded gusset or web that is disposed at each corner to essentially configure the corners as leak proof connections between panels. While such container constructions can facilitate containing and handing of food products, such as in a food processing plant, one known problem that may be associated with leakproof containers is the potential of foreign object contamination. For example, in production processes for corrugated container blanks configurated and used for forming current leakproof containers, there is potential for corrugated trim to remain attached to the container blank. Hence, there remains a possibility that trim debris may release from a container to contaminate the container contents, such as when containers are assembled manually or mechanically and/or when containers are positioned in close relation to each other as trim falls in between stacked containers during manufacturing, wherein the trim can find its way into assembled boxes filled with product.

An additional problem identified in prior containers that incorporate a self-locking design is that the containers can be difficult to lock into an assembled configuration and/or secure assembly of the container may not be maintained if the container is not set up correctly.

SUMMARY OF THE INVENTION

In accordance with an aspect of the present disclosure, a blank for making a leak proof container is described. The blank comprises a bottom panel having a plurality of peripheral edges. First and second side panels are connected to the bottom panel at opposing lateral peripheral edges and define lower edges of the container. First and second end portions are located at opposing longitudinal ends of the blank. Each end portion includes an inner end panel connected to a longitudinal peripheral edge of the bottom panel, an outer end panel having an inner longitudinal edge connected to a longitudinal edge of the inner end panel at hinge portions, first and second corner panels, each corner panel having an inner longitudinal edge connected to a respective one of the first and second side panels and an inner lateral edge connected to a lateral edge of the inner end panel, and each corner panel including a notch formed in at least one of an outer longitudinal edge and an outer lateral edge of the corner panel. First and second locking tabs are defined in the outer end panel, each locking tab being defined by a lateral tab separation line located longitudinally inward from an outer longitudinal edge of the outer end panel and extending laterally to define a free tab end.

The hinge portions may comprise laterally spaced first and second hinge portions, each hinge portion may be defined by a pair of longitudinally spaced hinge score lines and a pair of laterally spaced hinge separation lines extending longitudinally between the pair of longitudinally spaced hinge score lines.

Each corner panel may include a pair of notches comprising a longitudinal notch and a lateral notch extending along the outer longitudinal edge and the outer lateral edge, respectively, of the corner panel.

The longitudinal and lateral notches may define respective longitudinal and lateral notch dimensions, and the longitudinal and lateral notch dimensions may be greater than a lateral dimension of the hinge portions, measured between the laterally spaced hinge separation lines.

The blank may include a separation line longitudinally aligned with the first and second hinge portions and defining a boundary between the inner and outer end panels.

The corner panels may be formed as square panels, and may include a diagonal fold line dividing each corner panel into first and second triangular gusset panels.

The outer lateral edge of each corner panel may be collinear with a lateral edge of the blank defined by an edge of one of the first and second side panels.

A longitudinal tab separation line may extend longitudinally inward from the outer longitudinal edge of the outer end panel to each of the lateral tab separation lines, wherein the longitudinal tab separation lines may angle laterally inward toward each other extending from the outer longitudinal edge of the outer end panel toward a respective lateral tab separation line, and the free ends of the tabs may be defined at the longitudinal tab separation lines.

A longitudinal dimension of the outer end panel may be substantially less than a longitudinal dimension of the inner end panel.

In accordance with another aspect of the present disclosure, a container is provided including a bottom panel and a plurality of side panels, and a plurality of overlapping end panels defining at least one end portion. The at least one end portion comprises a first locking feature formed integral with at least one end panel and engaged with an additional end panel positioned in overlapping relationship with the at least one end panel to at least partially lock one or more of the end panels in an assembled position at the end portion. The at least one end portion additionally comprises a second locking feature formed integral with the at least one end panel and configured differently from the first locking feature, wherein the second locking feature is engaged with the additional end panel to at least partially lock one or more of the end panels in an assembled position at the end portion.

At least a portion of the first locking feature may be located adjacent to a first longitudinal edge of the at least one end panel, and at least a portion of the second locking feature may be located adjacent to a second longitudinal edge of the at least one end panel, opposite from the first longitudinal edge.

The first locking feature may apply a force to the additional end panel in a first direction to maintain the additional end panel in a position oriented transverse to at least one side panel, and the second locking feature may apply a force to the at least one end panel to resist movement of the at least one end panel in a direction opposite to the first direction.

The plurality of end panels may comprise an inner end panel connected to the bottom panel and an outer end panel connected to the inner end panel and positioned in overlapping relation to the inner end panel.

The first locking feature may comprise a hinge portion connecting the outer end panel to the inner end panel, and the hinge portion may engage a notch area formed in an edge of the additional end panel.

The second locking feature may comprise a locking tab positioned between the additional end panel and the inner end panel.

The additional end panel may comprise a gusset connected to a side panel and positioned between the outer end panel and the inner end panel.

In accordance with another aspect of the present disclosure, a container is provided including a bottom panel defining a bottom of the container and having a plurality of peripheral edges. First and second side panels are connected to the bottom panel at opposing lateral peripheral edges and folded upward relative to the bottom panel. First and second end portions are located at opposing longitudinal ends of the blank. Each end portion includes an inner end panel connected to a longitudinal peripheral edge of the bottom panel, an outer end panel having an inner longitudinal edge connected to an outer longitudinal edge of the inner end panel at hinge portions, first and second corner panels, each corner panel including inner longitudinal and lateral edges connected to respective edges of a side panel and the inner end panel, each corner panel folded about a diagonal gusset fold line to define a gusset, and each gusset including an edge portion defining a first locking feature for maintaining a respective gusset in a predetermined position adjacent to the inner panel, a second locking feature defined in the outer end panel for maintaining the outer end panel in a predetermined position adjacent to the gussets and the inner end panel. The outer end panel is folded about the hinge portions to overlapping relationship with at least a portion of each of the gussets to engage the first locking feature, and the second locking feature is positioned in cooperating engagement with the gussets.

The first locking feature may comprise a notch area defined on an upper edge of each gusset.

The notch area defined in the upper edge of each gusset may be engaged by a respective hinge portion.

The notch areas engaged by respective hinge portions may be located below upper edges of respective gussets, and the hinge portions may extend below an upper edge of the container defined by the outer longitudinal edge of the inner end panel.

A length dimension of each notch area, extending parallel to the upper edge of a respective gusset, may be greater than a length dimension of a respective hinge portion engaged in the notch area.

The second locking feature may comprise first and second locking tabs, each locking tab may be defined by a lateral tab separation line located longitudinally inward from an outer longitudinal edge of the outer end panel and extending laterally to define a free tab end.

The free tab ends may be positioned between a respective gusset and the inner end panel to retain the outer end panel in position over the gussets.

A longitudinal tab separation line may extend longitudinally inward from the outer longitudinal edge of the outer end panel to each of the lateral tab separation lines, wherein the free ends of the tabs may be defined at the longitudinal tab separation lines.

In accordance with a further aspect of the present disclosure, a method of forming a container from a blank is provided. The blank comprises a bottom panel having a plurality of peripheral edges, first and second side panels connected to the bottom panel at opposing lateral peripheral edges and defining lower edges of the container, first and second end portions located at opposing longitudinal ends of the blank, each end portion including an inner end panel connected to a longitudinal peripheral edge of the bottom panel, an outer end panel having an inner longitudinal edge connected to an outer longitudinal edge of the inner end panel at hinge portions. The blank further includes first and second corner panels, each corner panel having an inner longitudinal edge connected to a respective one of the first and second side panels and an inner lateral edge connected to a lateral edge of the inner end panel, and each corner panel including a notch formed in at least one of an outer longitudinal edge and an outer lateral edge of the corner panel, and first and second locking tabs are defined in the outer end panel. The method includes forming an end portion of the container comprising: folding the side panels and inner end panel upward from the bottom panel, and simultaneously folding each corner panel about a diagonal gusset fold line to define a gusset; folding each gusset perpendicular to a respective side panel to overlapping relationship with the inner end panel; folding the outer end panel about the hinge portions to engage the hinge portions in respective notch areas defined in the gussets by the notches in the corner panels; and positioning the locking tabs between a respective gusset and the inner end panel to retain the outer end panel in position over the gussets.

Engaging the hinge portions in the respective notch areas defined in the gussets may maintain each gusset in a predetermined position adjacent to the inner panel prior to positioning of the locking tabs.

A length dimension of each notch area, extending parallel to an upper edge of a respective gusset, may be greater than a length dimension of a respective hinge portion engaged in the notch area.

Folding the outer end panel about the hinge portions may comprise folding the hinge portions outward from the inner end panel to overlap the hinge portions across upper edges of respective gussets.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
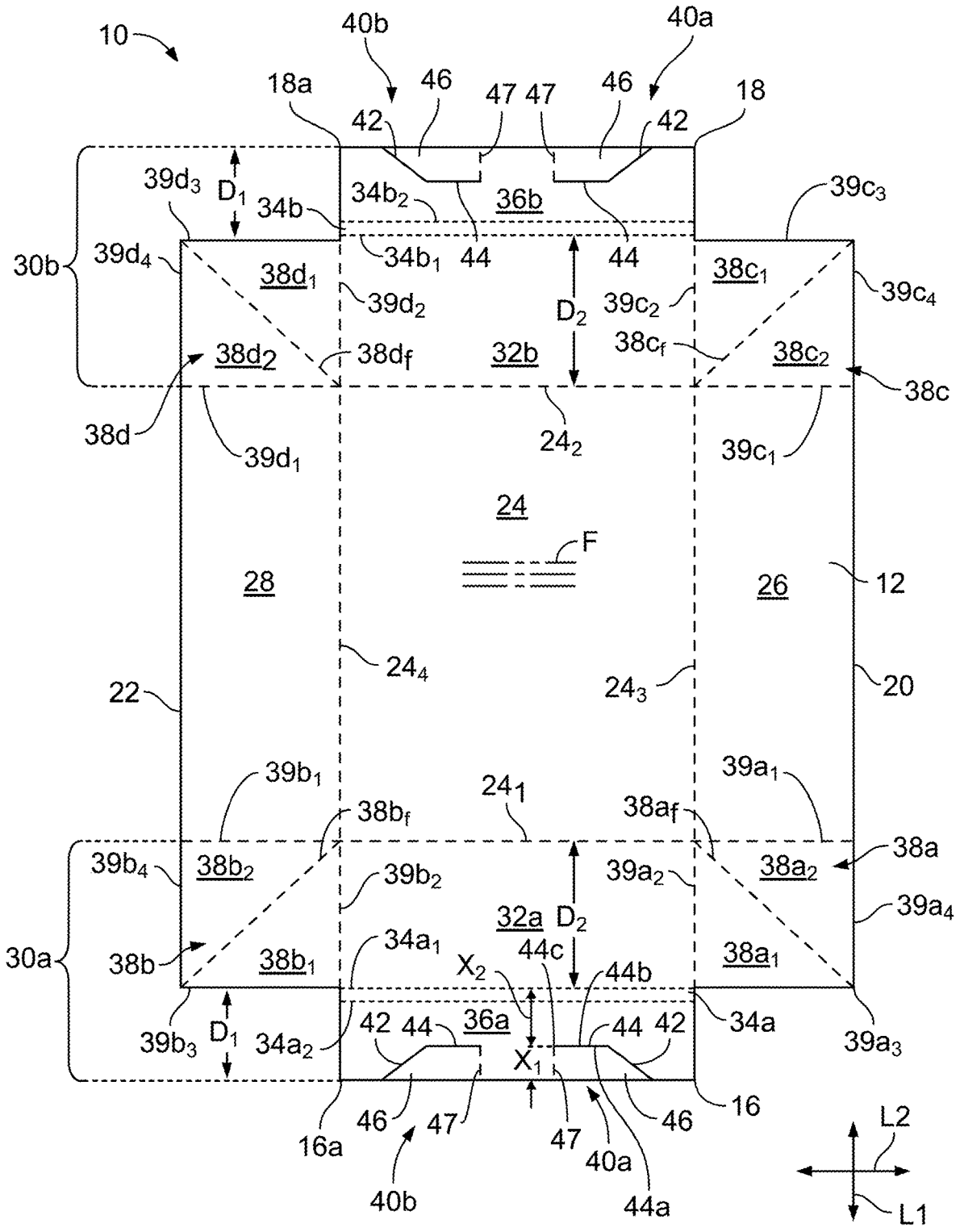
FIG. 1 is a plan view of a blank for forming a leak proof container.
Figure 2:
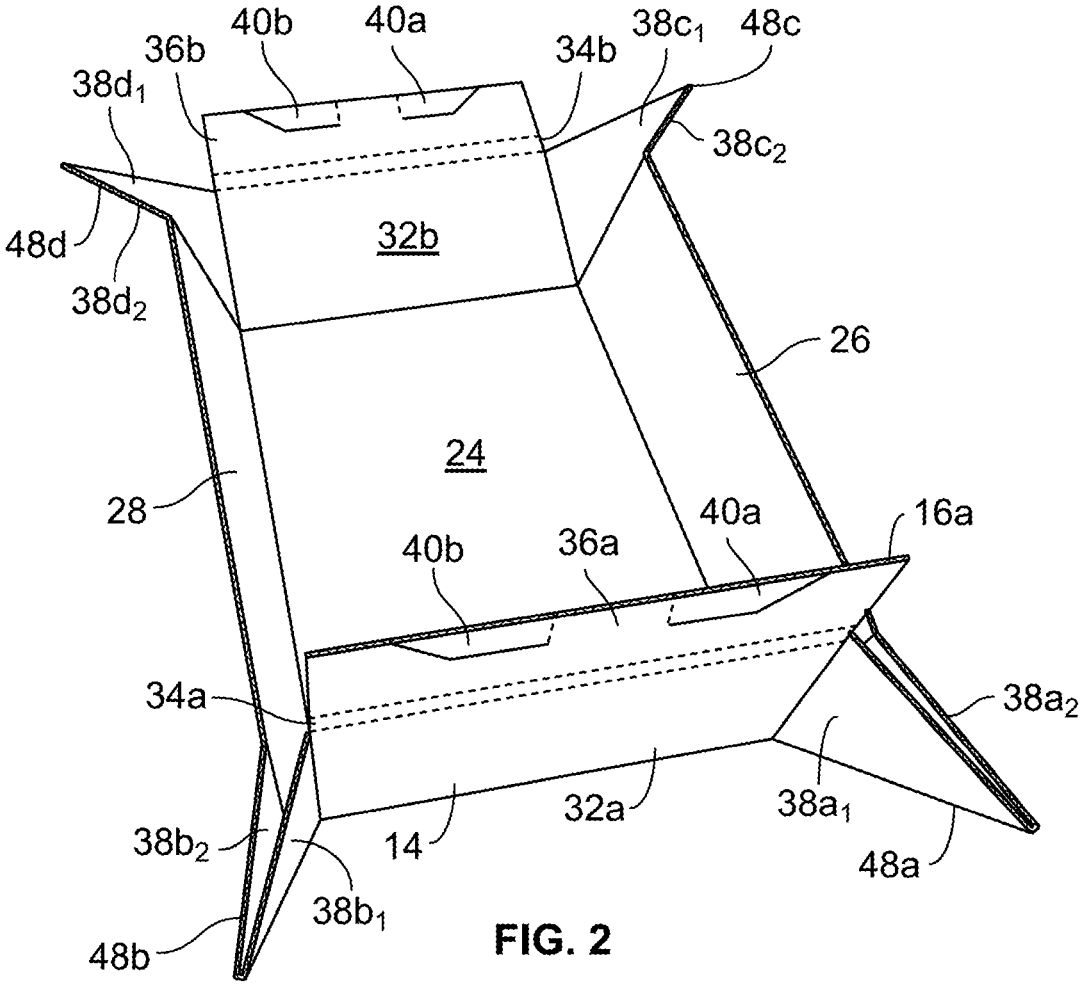
FIG. 2 is a perspective view of an initial step in folding the blank to erect the leak proof container.

Referring to FIG. 1, a die cut blank 10 is shown for illustrating one or more aspects of a container or tray comprising a leak resistant container, as described herein. In a use of the blank 10 to form a one-piece leak proof container 8, see FIG. 5, the blank 10 may be formed of a corrugated cardboard material having an interior portion defined by elongated flutes, generally designated F in FIG. 1, as is generally known in the art, and may be die cut to the shape shown herein, although other materials and variations of the illustrated shape may be provided within the scope of the container described herein. The blank 10 illustrated in FIG. 1 is a planar piece of material in which an inner side 12 is shown facing out of the page and an outer side 14, see FIG. 2, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral edges, generally designated 20 and 22, respectively. It may be noted that the flutes F extend in the lateral direction $L_2$.

The blank 10 comprises a bottom panel 24 having a plurality of peripheral edges $\mathbf{24}_1$, $\mathbf{24}_2$, $\mathbf{24}_3$, $\mathbf{24}_4$. A first side panel 26 is connected to the bottom panel 24 along a score line at the lateral peripheral edge $\mathbf{24}_3$, and a second side panel 28 is connected the bottom panel 24 along a score line at the opposing lateral peripheral edge $\mathbf{24}_4$. The peripheral edges $\mathbf{24}_1$, $\mathbf{24}_2$, $\mathbf{24}_3$, $\mathbf{24}_4$ define lower edges of the erected container 8.

First and second end portions 30*a*, 30*b* are located at the opposing longitudinal ends 16, 18 of the blank 10. Each end portion 30*a*, 30*b* includes a respective first and second inner end panels 32*a*, 32*b* connected to the longitudinal peripheral edges $\mathbf{24}_1$, $\mathbf{24}_2$ of the bottom panel 24 and extending between the lateral peripheral edges $\mathbf{24}_3$, $\mathbf{24}_4$. The first inner end panel 32*a* can include an outer longitudinal edge defined by a hinge portion 34*a* defined by a double score line $\mathbf{34}a_1$, $\mathbf{34}a_2$, and the second inner end panel 32*b* can include a hinge portion 34*b* defined by a double score line $\mathbf{34}b_1$, $\mathbf{34}b_2$. It should be understood that the inner end panels 32*a*, 32*b* may alternatively comprise hinge portions 34*a*, 34*b* defined by a single score line $\mathbf{34}a_1$, $\mathbf{34}b_1$.

The end portions 30*a*, 30*b* further include respective first and second outer end panels 36*a*, 36*b*. The first outer end panel 36*a* is hingedly joined to the first inner end panel 32*a* at the hinge portion 34*a*, and the second outer end panel 36*b* is hingedly joined to the second inner panel 32*b* at the hinge portion 34*b*. An inner longitudinal edge of the first outer end panel 36*a* can be connected to the first inner end panel 32*a* at the hinge portion 34*a*, and an outer longitudinal edge 16*a* of the first outer end panel 36*a* corresponds to the first longitudinal end 16 of the blank 10. An inner longitudinal edge of the second outer end panel 36*b* can be connected to the second inner end panel 32*b* at the hinge portion 34*b*, and an outer longitudinal edge 18*a* of the second outer end panel 36*b* corresponds to the second longitudinal end 18 of the blank 10. The first and second outer end panels 36*a*, 36*b* can be formed with a longitudinal dimension $D_1$ that is substantially less than a longitudinal dimension $D_2$ of the first and second inner end panels 32*a*, 32*b*.

The first end portion 30*a* additionally includes first and second corner panels 38*a*, 38*b* having inner longitudinal edges connected to the respective first and second side panels 26, 28 at score lines $\mathbf{39}a_1$, $\mathbf{39}b_1$ collinear with the longitudinal peripheral edge $\mathbf{24}_1$, and connected to the first inner end panel 32*a* at respective score lines $\mathbf{39}a_2$, $\mathbf{39}b_2$ collinear with the lateral peripheral edges $\mathbf{24}_3$, $\mathbf{24}_4$. The first and second corner panels 38*a*, 38*b* can each be formed with a square configuration having respective outer longitudinal edges $\mathbf{39}a_3$, $\mathbf{39}b_3$ collinear, or generally collinear with the outer longitudinal edge of the first inner end panel 32*a*, e.g., at the score line $\mathbf{34}a_1$, and having outer lateral edges $\mathbf{39}a_4$, $\mathbf{39}b_4$ collinear with the first and second lateral edges 20, 22, respectively. The first corner panel 38*a* additionally includes a score line defining a respective gusset fold line $\mathbf{38}a_f$ extending diagonally across the corner panel 38*a* from an inner corner defined at an intersection of the score lines $\mathbf{39}a_1$ and $\mathbf{39}a_2$ to an intersection of the outer longitudinal edge $\mathbf{39}a_3$ and outer lateral edge $\mathbf{39}a_4$. Similarly, the second corner panel 38*b* additionally includes a score line defining a respective gusset fold line $\mathbf{38}b_f$ extending diagonally across the corner panel 38*b* from an inner corner defined at an intersection of the score lines $\mathbf{39}b_1$ and $\mathbf{39}b_2$ to an intersection of the outer longitudinal edge $\mathbf{39}b_3$ and outer lateral edge $\mathbf{39}b_4$ The diagonal fold lines $\mathbf{38}a_f$, $\mathbf{38}b_f$ divide the first and second corner panels 38*a*, 38*b* into first and second triangular gusset panels $\mathbf{38}a_1$, $\mathbf{38}a_2$ and $\mathbf{38}b_1$, $\mathbf{38}b_2$, respectively.

The second end portion 30*b* additionally includes first and second corner panels 38*c*, 38*d* having inner longitudinal edges connected to the respective first and second side panels 26, 28 at score lines $\mathbf{39}c_1$, $\mathbf{39}d_1$ collinear with the longitudinal peripheral edge $\mathbf{24}_2$, and connected to the first inner end panel 32*b* at respective score lines $\mathbf{39}c_2$, $\mathbf{39}d_2$ collinear with the lateral peripheral edges $\mathbf{24}_3$, $\mathbf{24}_4$. The first and second corner panels 38*c*, 38*d* can each be formed with a square configuration having respective outer longitudinal edges $\mathbf{39}c_3$, $\mathbf{39}d_3$ collinear, or generally collinear with the outer longitudinal edge of the second inner end panel 32*b*, e.g., at the score line 34$b_1$, and having outer lateral edges 39$c_4$, 39$d_4$ collinear with the first and second lateral edges 20, 22, respectively. The first corner panel 38*c* additionally includes a score line defining a respective gusset fold line 38$c_f$ extending diagonally across the corner panel 38*c* from an inner corner defined at an intersection of the score lines 39$c_1$ and 39$c_2$ to an intersection of the outer longitudinal edge 39$c_3$ and outer lateral edge 39$c_4$. Similarly, the second corner panel 38*d* additionally includes a score line defining a respective gusset fold line 38$d_f$ extending diagonally across the corner panel 38*d* from an inner corner defined at an intersection of the score lines 39$d_1$ and 39$d_2$ to an intersection of the outer longitudinal edge 39$d_3$ and outer lateral edge 39$d_4$ The diagonal fold lines 38$c_f$, 38$d_f$ divide the first and second corner panels 38*c*, 38*d* into first and second triangular gusset panels 38$c_1$, 38$c_2$ and 38$d_1$, 38$d_2$, respectively.

The first outer end panel 36*a* includes a pair of laterally spaced tabs or tab structures 40*a*, 40*b* extending inward from the outer longitudinal edge 16*a* of the outer end panel 36*a* to form a push lock body for the first outer end panel 36*a*. Similarly, the second outer end panel 36*b* includes a pair of laterally spaced tab structures 40*a*, 40*b* extending inward from the outer longitudinal edge 18*a* of the outer end panel 36*b* to form a push lock body for the second outer end panel 36*b*.

Each tab structure 40*a*, 40*b* defines a locking tab and is defined by a longitudinal separation line 42 extending longitudinally inward from a respective outer longitudinal edge 16*a*, 18*a*, and a lateral separation line 44 located longitudinally inward from the respective longitudinal edge 16*a*, 18*a* and intersecting the longitudinal separation line 42 at a free end 46 of the tabs 40*a*, 40*b*, wherein laterally outer edges 42*a* of the tab ends 46 are defined at the longitudinal separation lines 42. The lateral separation lines 44 are spaced from the outer longitudinal edge 16*a*, 18*a* of a respective outer end panel 36*a*, 36*b* a distance $X_1$ that is less than a distance $X_2$ from the lateral separation lines 42 to the respective inner longitudinal ends, e.g., at the hinge portions 34*a*, 34*b*, of the outer end panel 36*a*, 36*b*. The longitudinal separation lines 42 on each outer end panel 36*a*, 36*b* angle laterally inward toward each other extending from the outer longitudinal edge 16*a*, 18*a* of the outer end panel 36*a*, 36*b* toward a respective lateral separation line 44. Further, a hinge connection is defined at a score line 47 between each tab structure 40*a*, 40*b* and a respective outer end panel 36*a*, 36*b*.

As is exemplified in FIG. 1 by the tab structure 40*a* on the outer end panel 36*a*, each lateral separation line 44 is defined by a first, panel edge 44*a* and a second, tab edge 44*b* extending to an inner end 44*c* of the lateral separation line 44, wherein the panel edge 44*a* and the tab edge 44*b* are colinear to the lateral separation line 44, such as may be defined by a straight common knife cut or area. The longitudinal separation line 42 and the lateral separation line 44 can be defined by cut lines, e.g., clean cut lines, that extend completely through the outer end panel 36*a*, 36*b*. However, it may be understood that the separation lines 42, 44 may also be defined by perforations that extend completely or partially through the outer end panels 36*a*, 36*b*.

Referring to FIGS. 2-5 a method of forming the blank 10 into an erected container 8 is described. The side panels 26, 28 and inner end panels 32*a*, 32*b* are initially folded upward from the bottom panel 24. Simultaneously, the corner panels 38*a*, 38*b*, 38*c*, 38*d* can be folded about respective gusset fold lines 38$a_f$, 38$b_f$, 38$c_f$, 38$d_f$ to define gussets 48*a*, 48*b*, 48*c*, 48*d*. Subsequently, the gussets 48*a*, 48*b*, 48*c*, 48*d* can be folded perpendicular to a respective side panel 26, 28 into overlapping relationship with an inner end panel 32*a*, 32*b*, as illustrated by gussets 48*a*, 48*b* in overlapping relationship with the inner end panel 32*a* in FIG. 3. The configuration formed by the folded gussets 48*a*, 48*b*, 48*c*, 48*d* defines folded container corners that form a continuous connection between the side panels 26, 28 and the inner end panels 32*a*, 32*b* extending from the bottom panel 24 to an upper edge 50, see FIG. 5, of the container 8. Hence, the continuous configuration formed by the gussets 48*a*, 48*b*, 48*c*, 48*d* can prevent or substantially limit fluids from leaking out of the container 8 at junctions between the side panels 26, 28 and the inner end panels 32*a*, 32*b*.

Figure 3:
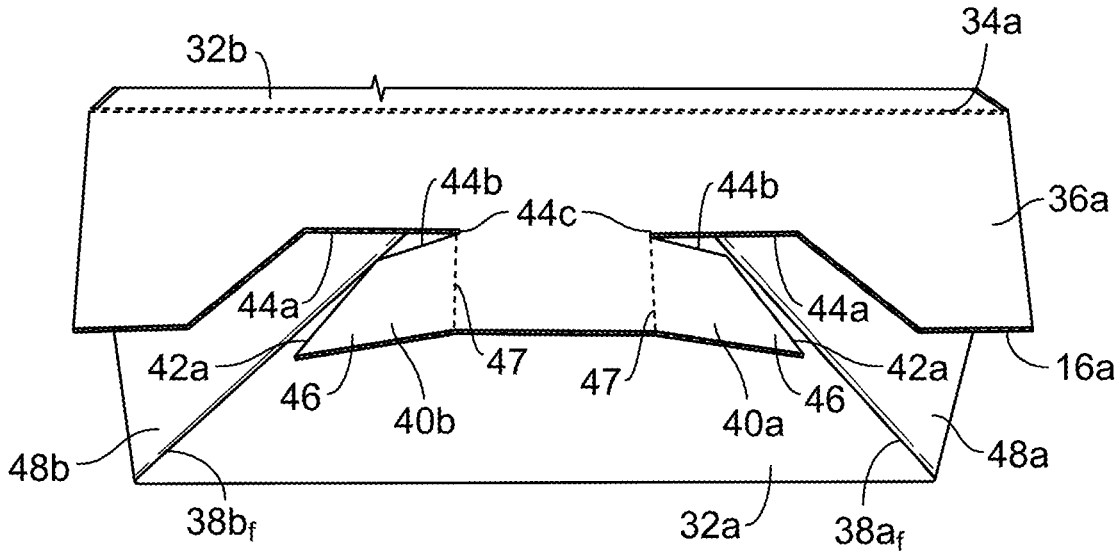
FIG. 3 is a perspective view illustrating folding of gussets over an inner end panel of the container and positioning locking tabs adjacent to edges of the gussets.

In the position depicted in FIG. 3, the outer end panel 36*a* is pivoted about the inner longitudinal edge, i.e., at the hinge portion 34*a*, to a position outwardly spaced from the inner end panel 32*a*. The tab structures 40*a*, 40*b* are pivoted about the score lines 47 to locate the edges 42*a* of the tab ends 46 adjacent to the inner end panel 32*a* near the gusset fold lines 38$a_f$, 38$b_f$ in preparation for positioning the tab ends 46 between the inner end panel 32*a* and the gussets 48*a*, 48*b*. It may be noted that the angled configuration of the edges 42*a* generally conforms to the angle of the gusset fold lines 38$a_f$, 38$b_f$ which can minimize the pivoting of the tabs 40*a*, 40*b* at the score lines 47 as the edges 42*a* are located near the gusset fold lines 38$a_f$, 38$b_f$.

Figure 4:
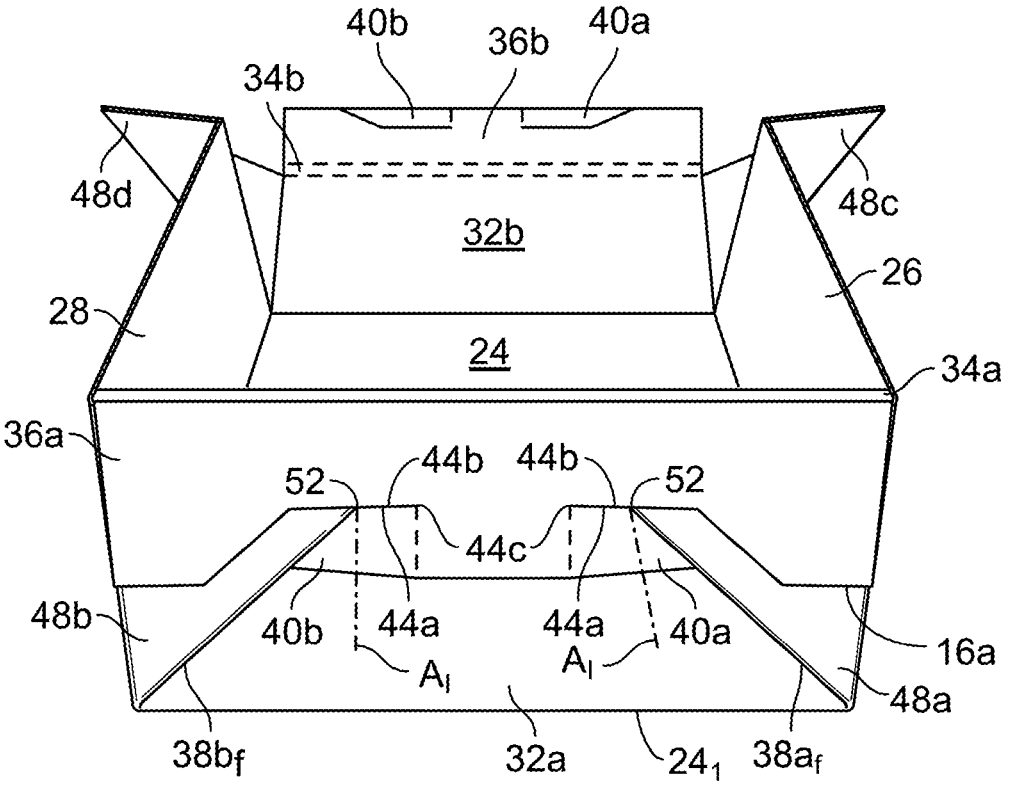
FIG. 4 is a perspective view illustrating inserting the locking tabs behind the gussets to form an end of the container.

As seen in FIG. 4, the outer end panel 36*a* and tabs 40*a*, 40*b* can be pushed inward toward the inner end panel 32*a* to insert the tab ends 46 of the tabs 40*a*, 40*b* between the inner end panel 32*a* and the gussets 48*a*, 48*b*, defining an inserted position of the tabs 40*a*, 40*b*. In the inserted tab position, the gusset fold lines 38$a_f$, 38$b_f$ intersect the respective adjacent panel edges 44*a* and tab edges 44*b* at a common intersection point 52, i.e. along a common intersection axis $A_I$. Each intersection point 52 defines a close fit between the gusset fold lines 38$a_f$, 38$b_f$ and respective adjacent panel edges 44*a* and tab edges 44*b*, forming a tight locking structure for retaining the outer end panel 36*a* in close overlapping relation over the inner end panel 32*a*, as well as to retain the gussets 48*a*, 48*b* in their folded positions overlapping the inner end panel 32*a*.

It may be noted that the outer longitudinal edges 16*a*, 16*b* of the outer end panels 36*a*, 36*b* may be located in vertically spaced relation from the bottom 24 of the container, i.e., the peripheral edges 24$_1$, 24$_2$. For example, the outer end panels 36*a*, 36*b* may extend approximately half-way down the inner end panels 32*a*, 32*b* to reduce the material required for the outer end panel material while providing sufficient structure to the tabs 40*a*, 40*b* to form a relatively rigid locking structure for retaining the outer end panels 36*a*, 36*b* and gussets 48*a*, 48*b*, 48*c*, 48*d* in their folded position.

Figure 5:
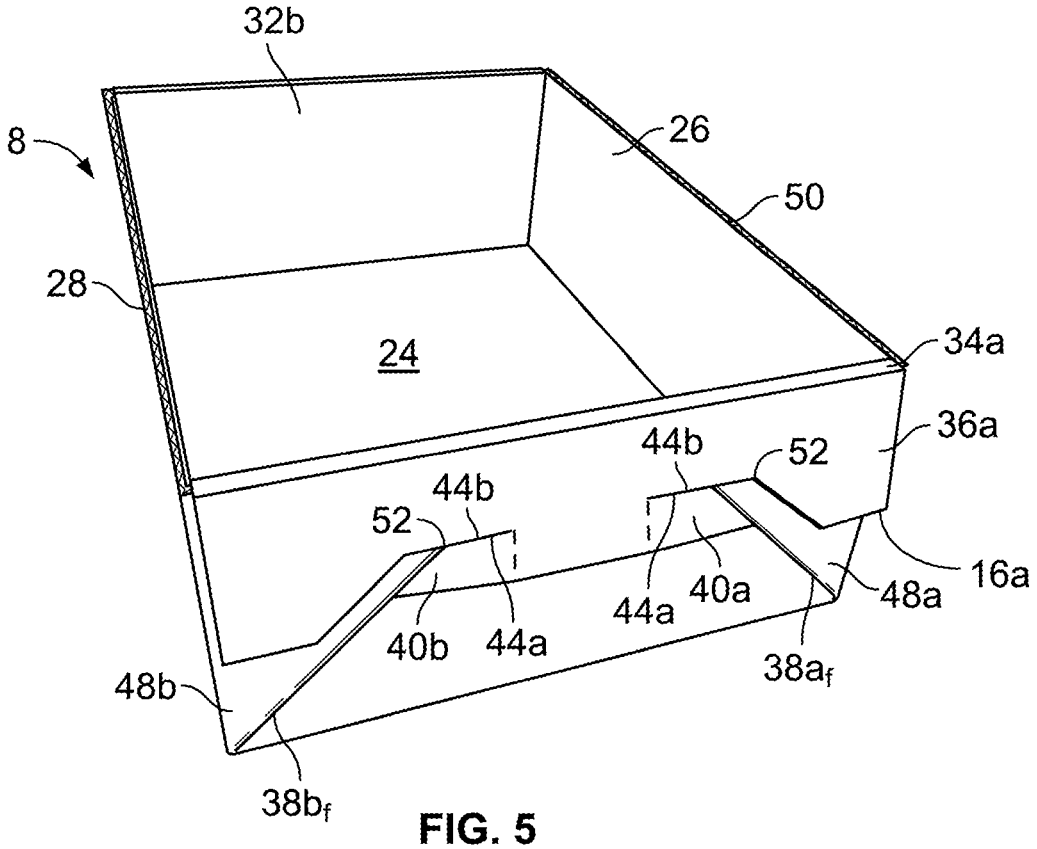
FIG. 5 is a perspective view of the erected leak proof container.

The inner end panel 32*b*, outer end panel 36*b*, and gussets 48*c*, 48*d* forming the opposing end of the container 8 can be folded in manner similar to that described above for the inner end panel 32*a*, outer end panel 36*a*, and gussets 48*a*, 48*b* to form the completed container 8, as illustrated in FIG. 5. The described container provides a configuration that can be readily assembled manually, with positively locking tab structures 40*a*, 40*b* that are conveniently manipulated to provide a securely constructed container. Also, it should be noted that, although the described construction of the container presents the gussets 48*a*, 48*b*, 48*c*, 48*d* being folded outward of the container, the gussets 48*a*, 48*b*, 48*c*, 40*d* may alternatively be folded inward to overlap respective inner sides of the inner end panels 32*a*, 32*b* and the outer end panels 36*a*, 36*b* may be folded inward to place the locking tab structures 40*a*, 40*b* on the inner side of the container.

It may be understood that, by forming the tabs 40*a*, 40*b* with the described separation lines 42, 44, without additional features such as cutouts or slots, the potential for debris created from such cutouts or slots is avoided. Specifically, the blank and associated container described herein can reduce the potential for trim debris within the blank area by providing a clean outside perimeter, with straight cuts, including straight common knife areas, and no internal trim areas, such as are described for the separation lines 42, 44. Hence, the configuration of the blank 10 and resulting container 8 can provide a container for food products that can avoid or substantially reduce contamination as a result of eliminating internal scrap areas, for example, eliminating the release of debris from the blank structure and/or when scrap is released but falls in between plural containers as they are stacked or otherwise grouped together.

Referring to FIGS. 6-9, an alternative embodiment of a container 108 is illustrated wherein elements corresponding to elements of the container 8 described above with reference to FIGS. 1-5 are labeled with the same reference numeral increased by 100.

Figure 6:
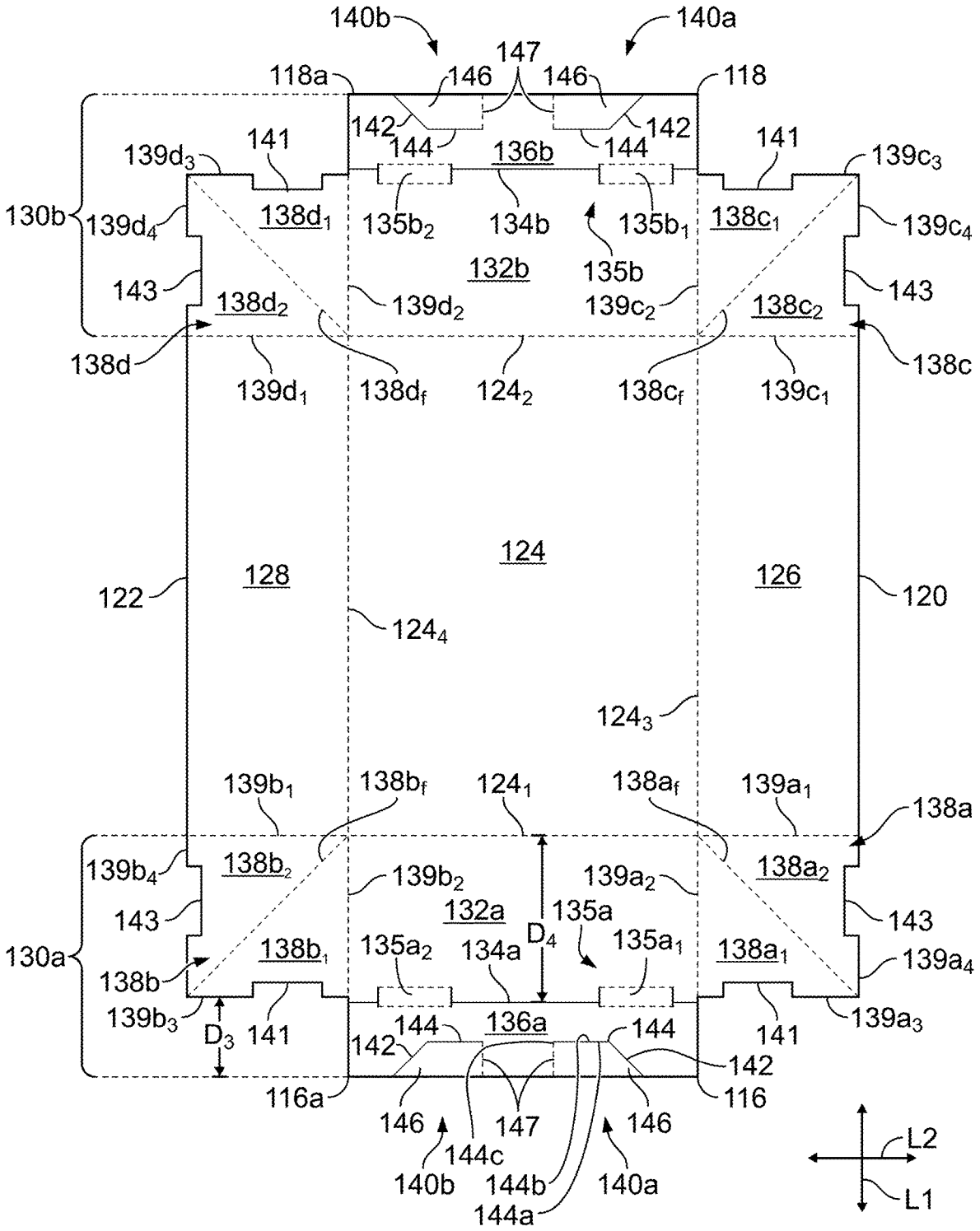
FIG. 6 is a plan view of a blank for forming an alternative embodiment of the leak proof container.

Referring initially to FIG. 6, a blank 110 for forming the container 108 comprises a bottom panel 124 having a plurality of peripheral edges $\mathbf{124}_1$, $\mathbf{124}_2$, $\mathbf{124}_3$, $\mathbf{124}_4$. A first side panel 126 is connected to the bottom panel 124 along a score line at the lateral peripheral edge $\mathbf{124}_3$, and a second side panel 128 is connected to the bottom panel 124 along a score line at the opposing lateral peripheral edge $\mathbf{124}_4$. The peripheral edges $\mathbf{124}_1$, $\mathbf{124}_2$, $\mathbf{124}_3$, $\mathbf{124}_4$ define lower edges of the erected container 108.

First and second end portions 130*a*, 130*b* are located at the opposing longitudinal ends 116, 118 of the blank 110. Each end portion 130*a*, 130*b* includes a respective first and second inner end panel 132*a*, 132*b* connected to the longitudinal peripheral edges $\mathbf{124}_1$, $\mathbf{124}_2$ of the bottom panel 124 and extending between the lateral peripheral edges $\mathbf{124}_3$, $\mathbf{124}_4$. The first inner end panel 132*a* can include an outer longitudinal edge defined by a separation line 134*a*, and the second inner end panel 132*b* can include can include an outer longitudinal edge defined by a separation line 134*b*. The separation lines 134*a*, 134*b* may comprise clean cut lines providing a line of separation between the inner end panels 132*a*, 132*b* and the respective outer end panels 136*a*, 136*b*.

The end portions 130*a*, 130*b* further include respective first and second outer end panels 136*a*, 136*b*. The first outer end panel 136*a* is hingedly joined to the first inner end panel 132*a* at integral hinge portions 135*a* that can comprise first and second laterally spaced hinge portions $\mathbf{135}a_1$, $\mathbf{135}a_2$, and the second outer end panel 136*b* is hingedly joined to the second inner panel 132*b* at integral hinge portions 135*b* that can comprise first and second laterally spaced hinge portions $\mathbf{135}b_1$, $\mathbf{135}b_2$. A first or inner longitudinal edge of the first outer end panel 136*a* is defined at the separation line 134*a*, wherein the hinge portions 135*a* are longitudinally aligned with and extend across the separation line 134*a* to connect the first outer end panel 136*a* to the first inner end panel 132*a*, and a second or outer longitudinal edge 116*a* of the first outer end panel 136*a* corresponds to the first longitudinal end 116 of the blank 110. A first or inner longitudinal edge of the second outer end panel 136*b* is defined at the separation line 134*b*, wherein the hinge portions 135*b* are longitudinally aligned with and extend across the separation line 134*b* to connect the second outer end panel 136*b* to the second inner end panel 132*b*, and a second or outer longitudinal edge 118*a* of the second outer end panel 136*b* corresponds to the second longitudinal end 118 of the blank 110. The first and second outer end panels 136*a*, 136*b* can be formed with a longitudinal dimension $D_3$ that is substantially less than a longitudinal dimension $D_4$ of the first and second inner end panels 132*a*, 132*b*.

The first end portion 130*a* additionally includes first and second corner panels 138*a*, 138*b* having inner longitudinal edges connected to the respective first and second side panels 126, 128 at score lines $\mathbf{139}a_1$, $\mathbf{139}b_1$ collinear with the longitudinal peripheral edge $\mathbf{124}_1$, and having inner lateral edges connected to the first inner end panel 132*a* at respective score lines $\mathbf{139}a_2$, $\mathbf{139}b_2$ collinear with the lateral peripheral edges $\mathbf{124}_3$, $\mathbf{124}_4$. The first and second corner panels 138*a*, 138*b* can each be formed with a square configuration having respective outer longitudinal edges $\mathbf{139}a_3$, $\mathbf{139}b_3$ collinear, or generally collinear with the outer longitudinal edge of the first inner end panel 132*a*, e.g., at the separation line 134*a*, and having outer lateral edges $\mathbf{139}a_4$, $\mathbf{139}b_4$ collinear with the first and second lateral edges 120, 122, respectively. The first corner panel 138*a* additionally includes a score line defining a respective gusset fold line $\mathbf{138}a_f$ extending diagonally across the corner panel 138*a* from an inner corner defined at an intersection of the score lines $\mathbf{139}a_1$ and $\mathbf{139}a_2$ to an intersection of the outer longitudinal edge $\mathbf{139}a_3$ and outer lateral edge $\mathbf{139}a_4$. Similarly, the second corner panel 138*b* additionally includes a score line defining a respective gusset fold line $\mathbf{138}b_f$ extending diagonally across the corner panel 138*b* from an inner corner defined at an intersection of the score lines $\mathbf{139}b_1$ and $\mathbf{139}b_2$ to an intersection of the outer longitudinal edge $\mathbf{139}b_3$ and outer lateral edge $\mathbf{139}b_4$. The diagonal fold lines $\mathbf{138}a_f$, $\mathbf{138}b_f$ divide the first and second corner panels 138*a*, 138*b* into first and second triangular gusset panels $\mathbf{138}a_1$, $\mathbf{138}a_2$ and $\mathbf{138}b_1$, $\mathbf{138}b_2$, respectively.

The second end portion 130*b* additionally includes first and second corner panels 138*c*, 138*d* having inner longitudinal edges connected to the respective first and second side panels 126, 128 at score lines $\mathbf{139}c_1$, $\mathbf{139}d_1$ collinear with the longitudinal peripheral edge $\mathbf{124}_2$, and having inner lateral edges connected to the second inner end panel 132*b* at respective score lines $\mathbf{139}c_2$, $\mathbf{139}d_2$ collinear with the lateral peripheral edges $\mathbf{124}_3$, $\mathbf{124}_4$. The first and second corner panels 138*c*, 138*d* can each be formed with a square configuration having respective outer longitudinal edges $\mathbf{139}c_3$, $\mathbf{139}d_3$ collinear, or generally collinear with the outer longitudinal edge of the second inner end panel 132*b*, e.g., at the separation line 134*b*, and having outer lateral edges $\mathbf{139}c_4$, $\mathbf{139}d_4$ collinear with the first and second lateral edges 120, 122, respectively. The first corner panel 138*c* additionally includes a score line defining a respective gusset fold line $\mathbf{138}c_f$ extending diagonally across the corner panel 138*c* from an inner corner defined at an intersection of the score lines $\mathbf{139}c_1$ and $\mathbf{139}c_2$ to an intersection of the outer longitudinal edge $\mathbf{139}c_3$ and outer lateral edge $\mathbf{139}c_4$. Similarly, the second corner panel 138*d* additionally includes a score line defining a respective gusset fold line $\mathbf{138}d_f$ extending diagonally across the corner panel 138*d* from an inner corner defined at an intersection of the score lines $\mathbf{139}d_1$ and $\mathbf{139}d_2$ to an intersection of the outer longitudinal edge $\mathbf{139}d_3$ and outer lateral edge $\mathbf{139}d_4$ The diagonal fold lines $\mathbf{138}c_f$, $\mathbf{138}d_f$ divide the first and second corner panels 138*c*, 138*d* into first and second triangular gusset panels $\mathbf{138}c_1$, $\mathbf{138}c_2$ and $\mathbf{138}d_1$, $\mathbf{138}d_2$, respectively.

Further, each of the corner panels 138*a*, 138*b*, 138*c*, 138*d* can include a pair of notches. As seen in FIG. 6, the pair of notches can comprise a longitudinal notch 141 located extending along a respective outer longitudinal edge $\mathbf{139}a_3$,

139$b_3$, 139$c_3$, 139$d_3$, and a lateral notch 143 extending along a respective outer lateral edge 139$a_4$, 139$b_4$, 139$c_4$, 139$d_4$.

Figure 6A:
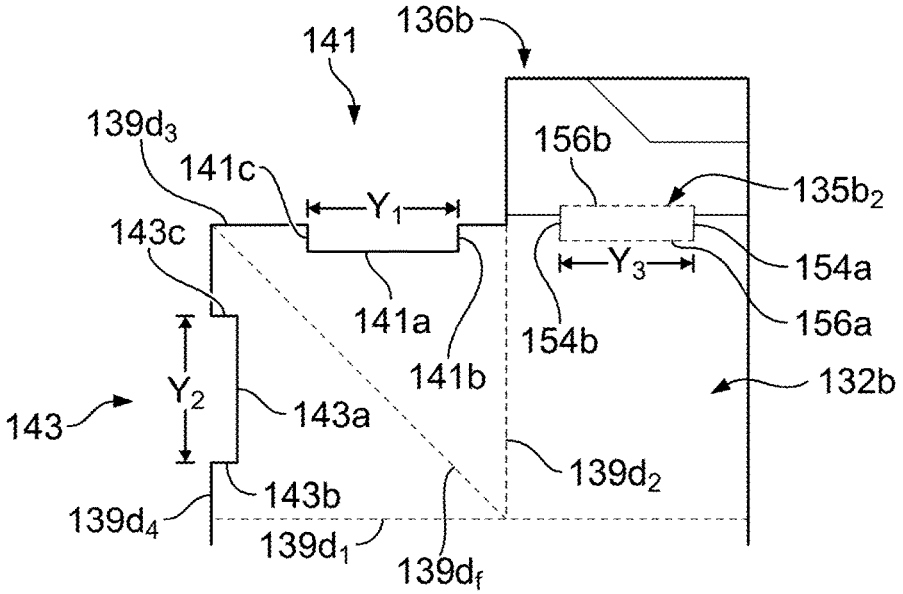
FIG. 6A is an enlarged view of a corner panel and adjacent hinge portion of the blank of FIG. 6.

Referring further to FIG. 6A, an enlarged view of the corner panel 138*d* and adjacent hinge portion 135$b_2$ is shown, which is typical of, or generally identical to, the remaining corner panels 138*a*, 138*b*, 138*c* and respective hinge portions 135$a_1$, 135$a_2$, 135$b_1$. The notches 141, 143 are configured the same or substantially the same, and each notch 141, 143 includes a respective inner edge 141*a*, 143*a*, and side edges 141*b*, 141*c* and 143*b*, 143*c* extending perpendicular to the respective inner edge 141*a*, 143*a*.

Additionally, the hinge portion 135$b_2$ is defined between a pair of laterally spaced hinge separation lines 154*a*, 154*b*, e.g., clean cut lines, that span across the separation line 134*b*. The hinge 135$b_2$ is further defined between laterally extending score lines 156*a*, 156*b* that extend between ends of the separation lines 154*a*, 154*b*, and that form hinge locations for hingedly supporting the second outer end panel 136*b* to the second inner end panel 132*b*.

The longitudinal notch 141 defines a longitudinal notch dimension $Y_1$, i.e., a length dimension extending between the side edges 141*b*, 141*c*, and the lateral notch 143 defines a lateral notch dimension $Y_2$, i.e., a length dimension extending between the side edges 143*b*, 143*c*, that is equal to, or substantially equal to, the longitudinal notch dimension $Y_1$. The hinge portion 135$b_2$ defines a lateral hinge dimension $Y_3$, i.e., a length dimension extending between the cut lines 154*a*, 154*b*, wherein the lateral hinge dimension $Y_3$ is preferably less than the longitudinal notch dimension $Y_1$ and the lateral notch dimension $Y_2$. In a non-limiting exemplary embodiment, the lateral hinge dimension $Y_3$ may be 2.25 inches and the longitudinal and lateral notch dimensions $Y_1$, $Y_2$ may each be 2.5 inches, such that the lateral hinge dimension $Y_3$ may be approximately 10% less than the longitudinal and lateral notch dimensions $Y_1$, $Y_2$.

It should be understood that, although the notches 141, 143 are described as being defined between respective side edges, 141*b*, 141*c* and 143*b*, 143*c*, in some embodiments the notches 141, 143 may include an open side, such as may be defined, for example, by a notch 141, 143 that has a side edge aligned with a score line 139$a_1$, 139$a_2$, 139$b_1$, 139$b_2$, 139$c_1$, 139$c_2$, 139$d_1$, 139$d_2$ defining a side edge of the corner panel 138*a*, 138*b*, 138*c*, 138*d*.

Referring to FIG. 6, The first outer end panel 136*a* includes a pair of laterally spaced tabs or tab structures 140*a*, 140*b* formed integral with the outer end panel 136*a* and extending inward from the outer longitudinal edge 116*a* of the outer end panel 136*a* to form a push lock body for the first outer end panel 136*a*. Similarly, the second outer end panel 136*b* includes a pair of laterally spaced tab structures 140*a*, 140*b* formed integral with the outer end panel 136*b* and extending inward from the outer longitudinal edge 118*a* of the second outer end panel 136*b* to form a push lock body for the second outer end panel 136*b*.

Each tab structure 140*a*, 140*b* defines a locking tab and is defined by a longitudinal separation line 142 extending longitudinally inward from a respective outer longitudinal edge 116*a*, 118*a*, and a lateral separation line 144 located longitudinally inward from the respective longitudinal edge 116*a*, 118*a* and intersecting the longitudinal separation line 142 at a free end 146 of the tabs 140*a*, 140*b*, wherein laterally outer edges of the tab ends 146 are defined at the longitudinal separation lines 142. The longitudinal separation lines 142 on each outer end panel 136*a*, 136*b* angle laterally inward toward each other extending from the outer longitudinal edge 116*a*, 118*a* of the outer end panel 136*a*, 136*b* toward a respective lateral separation line 144. Further, a hinge connection is defined at a score line 147 between each tab structure 140*a*, 140*b* and a respective outer end panel 136*a*, 136*b*.

As is exemplified in FIG. 6 by the tab structure 140*a* on the outer end panel 136*a*, each lateral separation line 144 is defined by a first, panel edge 144*a* and a second, tab edge 144*b* extending to an inner end 144*c* of the lateral separation line 144, wherein the panel edge 144*a* and the tab edge 144*b* are collinear to the lateral separation line 144, such as may be defined by a straight common knife cut or area. The longitudinal separation line 142 and the lateral separation line 144 can be defined by cut lines, e.g., clean cut lines, that extend completely through the outer end panel 136*a*, 136*b*. However, it may be understood that the separation lines 142, 144 may also be defined by perforations that extend completely or partially through the outer end panels 136*a*, 136*b*.

Figure 7:
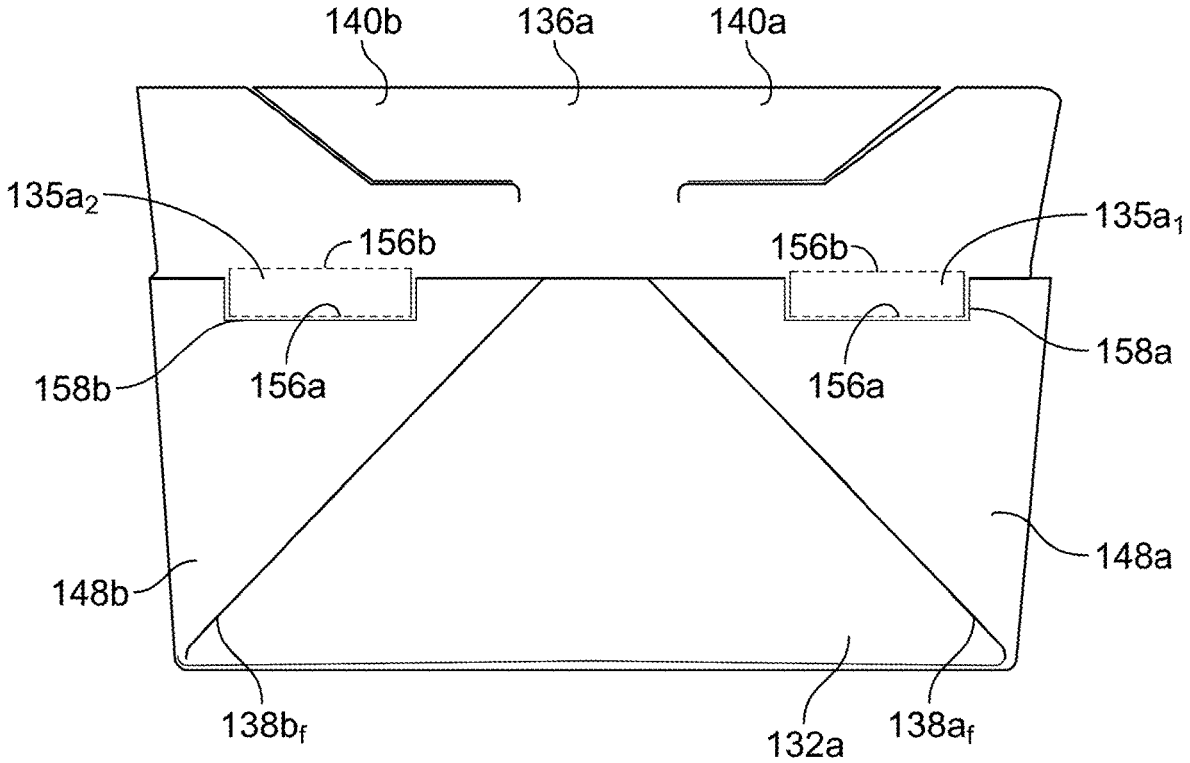
FIG. 7 is an end view of an initial step in forming an end portion of the leak proof container using the blank of FIG. 6.
Figure 8:
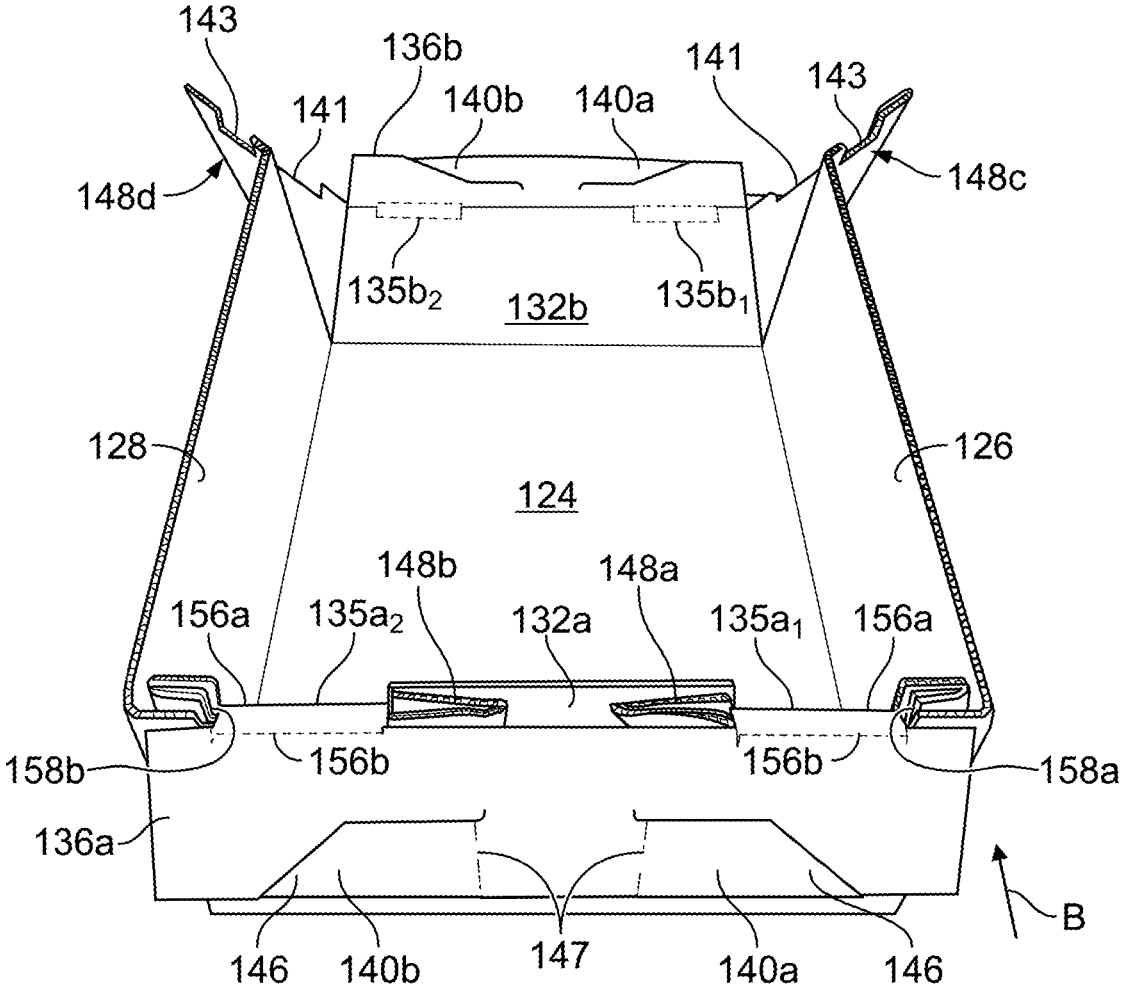
FIG. 8 is a perspective view of positioning hinge portions in notch areas at upper edges of gussets during formation of the end portion of the leak proof container using the blank of FIG. 6.
Figure 9:
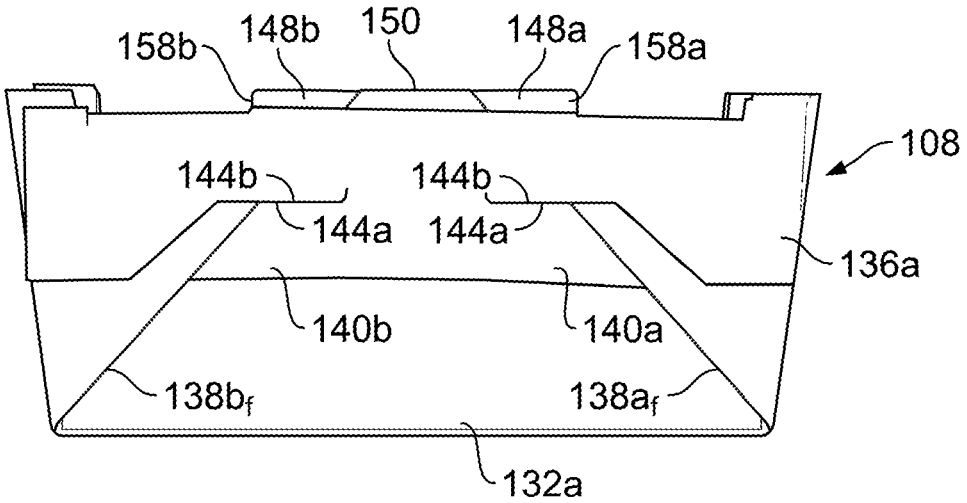
FIG. 9 is an end view of the erected leak proof container using the blank of FIG. 6.

Referring to FIGS. 7-9, a method of forming the blank 110 into an erected container 108 is described. The side panels 126, 128 and inner end panels 132*a*, 132*b* are initially folded upward from the bottom panel 24. Simultaneously, the corner panels 138*a*, 138*b*, 138*c*, 138*d* can be folded about respective gusset fold lines 138$a_f$, 138$b_f$, 138$c_f$, 138$d_f$ to define additional end panels comprising gussets 148*a*, 148*b*, 148*c*, 148*d*. Subsequently, the gussets 148*a*, 148*b*, 148*c*, 148*d* can be folded or pivoted transverse to, e.g., perpendicular to, a respective side panel 126, 128 into overlapping relationship with an inner end panel 132*a*, 132*b*, as illustrated by gussets 148*a*, 148*b* in overlapping relationship with the inner end panel 132*a* in FIG. 7. The configuration formed by the folded gussets 148*a*, 148*b*, 148*c*, 148*d* defines folded container corners that form a continuous connection between the side panels 126, 128 and the inner end panels 132*a*, 132*b* extending from the bottom panel 124 to an upper edge 150 of the container 108. Hence, the continuous configuration formed by the gussets 148*a*, 148*b*, 148*c*, 148*d* can prevent or substantially limit fluids from leaking out of the container 108 at junctions between the side panels 126, 128 and the inner end panels 132*a*, 132*b*.

In the position depicted in FIG. 7, the hinge portions 135$a_1$, 135$a_2$ are aligned with respective notch areas 158*a*, 158*b* formed in the gussets 148*a*, 148*b*. It may be noted that the notch areas 158*a*, 158*b* are formed in the upper edges of the gussets 148*a*, 148*b* by alignment of the respective longitudinal and lateral notch portions 141, 143 with one another as the corner panels 138*a*, 138*b* are folded.

As can be seen in FIG. 8, the first outer end panel 136*a* can be pivoted about the hinge portions 135$a_1$, 135$a_2$ to a position outwardly spaced from the inner end panel 132*a*. In particular, the hinge portions 135$a_1$, 135$a_2$ are pivoted across, or rolled over, the upper edges of the gussets 148*a*, 148*b* and positioned within the notch areas 158*a*, 158*b*. In the position illustrated in FIG. 8, the hinge portions 135$a_1$, 135$a_2$ and first outer end panel 136*a* can engage the upper edges of the gussets 148*a*, 148*b* to retain the gussets 148*a*, 148*b* in position closely adjacent to the first inner end panel 132*a*. Subsequently, the tab structures 140*a*, 140*b* can be manipulated to position the tab ends 146 of the tabs 140*a*, 140*b* between the inner end panel 132*a* and the gussets 148*a*, 148*b*, defining an inserted position of the tabs 140*a*, 140*b*, substantially as described above for the embodiment of FIGS. 1-5.

The inner end panel 132*b*, outer end panel 136*b*, and gussets 148*c*, 148*d* forming the opposing end of the container 108 can be folded in manner similar to that described above for the inner end panel 132*a*, outer end panel 136*a*, and gussets 148*a*, 148*b* to form the completed container 108, as illustrated in FIG. 9. The described container provides a configuration that can be readily assembled manually, with positively locking tab structures 140*a*, 140*b* that are conveniently manipulated to provide a securely constructed container. Further, the hinge portions 135$a_1$, 135$a_2$, 135$b_1$, 135$b_2$ engaged within respective notch areas 158*a*, 158*b* can define a first locking feature that is located at the first longitudinal edge of the outer end panel 136*a*, 136*b* that facilitates assembly of the container 108 by freeing an operator from having to hold the gussets 148*a*, 148*b*, 148*c*, 148*d* in position during insertion of the tab structures 140*a*, 140*b*, forming a second locking feature that is located at the second longitudinal edge of the outer end panel 136*a*, 136*b* and that is configured differently from the first locking feature.

It may be seen that the hinge portions 135$a_1$, 135$a_2$, 135$b_1$, 135$b_2$ engaged within the notch areas 158*a*, 158*b* provides a locking structure that can further maintain secure assembly of the container 108 in combination with the engagement of the tab structures 140*a*, 140*b* positioned behind the gussets 148*a*, 148*b*, 148*c*, 148*d*. In particular, the first locking feature, i.e., formed by the hinge portions 135$a_1$, 135$a_2$, 135$b_1$, 135$b_2$ engaged within respective notch areas 158*a*, 158*b*, can apply a force to the gussets 148*a*, 148*b*, 148*c*, 148*d* in a first direction, see FIG. 8 illustrating a first direction B relative to gussets 148*a*, 148*b*, to maintain the gussets 148*a*, 148*b*, 148*c*, 148*d* in a position oriented transverse to the side panels 126, 128, and the second locking feature, i.e., the tab structures 140*a*, 140*b* positioned behind the gussets 148*a*, 148*b*, 148*c*, 148*d*, applies a force to the outer end panels 136*a*, 136*b* to resist movement of the outer end panels 136*a*, 136*b* in a direction opposite to the first direction B.

Also, providing the notch areas 158*a*, 158*b* with a length dimension, as defined by the length dimensions $Y_1$, $Y_2$ of the notches 141, 143 parallel the upper edges of the gussets 148*a*, 148*b*, 148*c*, 148*d*, and greater than the length dimension of the hinge portions 135$a_1$, 135$a_2$, 135$b_1$, 135$b_2$, can enable the hinge portions 135$a_1$, 135$a_2$, 135$b_1$, 135$b_2$ to easily slip into the notch areas 158*a*, 158*b* without binding or interference during assembly of the container 108, without adversely affecting the locking function performed by the hinge portions 135$a_1$, 135$a_2$, 135$b_1$, 135$b_2$ and notch areas 158*a*, 158*b*.

As with the embodiment of FIGS. 1-5, it may be understood that, by forming the tabs 140*a*, 140*b* with the described separation lines 142, 144, without additional features such as cutouts or slots, the potential for debris created from such cutouts or slots is avoided. Specifically, the blank and associated container described herein can reduce the potential for trim debris within the blank area by providing a clean outside perimeter, including straight cuts to define the notch portions 141, 143, and no internal trim areas, such as are described for the separation lines 142, 144. Hence, the configuration of the blank 110 and resulting container 108 can provide a container for food products that can avoid or substantially reduce contamination as a result of eliminating internal scrap areas, for example, eliminating the release of debris from the blank structure and/or when scrap is released but falls in between plural containers as they are stacked or otherwise grouped together.

The configuration of the blank 110 and resulting container 108 is believed to also enable a reduction in material, e.g., in comparison to the blank 10 and associated container 8 described above, in that the locking feature provided by the hinge portions 135$a_1$, 135$a_2$, 135$b_1$, 135$b_2$ and associated notch areas 158*a*, 158*b* can provide additional stability to the ends of the container 108, allowing a reduction in the longitudinal length of the outer end panels 136*a*, 136*b*, i.e., longitudinal dimension $D_3$, while maintaining a secure assembly of the container 108.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a leak proof container comprising:

a bottom panel having a plurality of peripheral edges;

first and second side panels connected to the bottom panel at opposing lateral peripheral edges and defining lower edges of the container;

first and second end portions located at opposing longitudinal ends of the blank, each end portion including:

an inner end panel connected to a longitudinal peripheral edge of the bottom panel;

an outer end panel having an inner longitudinal edge connected to a longitudinal edge of the inner end panel at hinge portions;

first and second corner panels, each corner panel having an inner longitudinal edge connected to a respective one of the first and second side panels and an inner lateral edge connected to a lateral edge of the inner end panel, and each corner panel including a notch formed in at least one of an outer longitudinal edge and an outer lateral edge of the corner panel;

first and second locking tabs defined in the outer end panel, each locking tab defined by a lateral tab separation line located longitudinally inward from an outer longitudinal edge of the outer end panel and extending laterally to define a free tab end; and a longitudinal tab separation line extending longitudinally inward from the outer longitudinal edge of the outer end panel to each of the lateral tab separation lines, wherein the longitudinal tab separation lines angle laterally inward toward each other extending from the outer longitudinal edge of the outer end panel toward a respective lateral tab separation line, and the free ends of the tabs are defined at the longitudinal tab separation lines.

2. The blank as set forth in claim 1, wherein the hinge portions comprise laterally spaced first and second hinge portions, each hinge portion defined by a pair of longitudinally spaced hinge score lines and a pair of laterally spaced hinge separation lines extending longitudinally between the pair of longitudinally spaced hinge score lines.

3. The blank as set forth in claim 2, wherein each corner panel includes a pair of notches comprising a longitudinal notch and a lateral notch extending along the outer longitudinal edge and the outer lateral edge, respectively, of the corner panel.

4. The blank as set forth in claim 3, wherein the longitudinal and lateral notches define respective longitudinal and lateral notch dimensions, and the longitudinal and lateral notch dimensions are greater than a lateral dimension of the hinge portions, measured between the laterally spaced hinge separation lines.

5. The blank as set forth in claim 2, including a separation line longitudinally aligned with the first and second hinge portions and defining a boundary between the inner and outer end panels.

6. The blank as set forth in claim 1, wherein the corner panels are formed as square panels, and including a diagonal fold line dividing each corner panel into first and second triangular gusset panels.

7. The blank as set forth in claim 6, wherein the outer lateral edge of each corner panel is colinear with a lateral edge of the blank defined by an edge of one of the first and second side panels.

8. The blank as set forth in claim 1, wherein a longitudinal dimension of the outer end panel is substantially less than a longitudinal dimension of the inner end panel.

9. A container including a bottom panel and a plurality of side panels, and a plurality of overlapping end panels each comprising an inner end panel connected to the bottom panel and an outer end panel connected to the inner end panel and positioned in overlapping relation to the inner end panel and defining at least one end portion, the at least one end portion comprising:

a first locking feature formed integral with at least one end panel and engaged with an additional end panel positioned in overlapping relationship with the at least one end panel to at least partially lock one or more of the end panels in an assembled position at the end portion and comprises a hinge portion connecting the outer end panel to the inner end panel, and the hinge portion engages a notch area formed in an edge of the additional end panel; and a second locking feature formed integral with the at least one end panel and configured differently from the first locking feature, wherein the second locking feature is engaged with the additional end panel to at least partially lock one or more of the end panels in an assembled position at the end portion;

wherein the first locking feature applies a force to the additional end panel in a first direction to maintain the additional end panel in a position oriented transverse to at least one side panel, and the second locking feature applies a force to the at least one end panel to resist movement of the at least one end panel in a direction opposite to the first direction.

10. The container as set forth in claim 9, wherein at least a portion of the first locking feature is located adjacent to a first longitudinal edge of the at least one end panel, and at least a portion of the second locking feature is located adjacent to a second longitudinal edge of the at least one end panel, opposite from the first longitudinal edge.

11. The container as set forth in claim 9, wherein the second locking feature comprises a locking tab positioned between the additional end panel and the inner end panel.

12. The container as set forth in claim 11, wherein the additional end panel comprises a gusset connected to a side panel and positioned between the outer end panel and the inner end panel.

13. A container including a bottom panel defining a bottom of the container and having a plurality of peripheral edges, first and second side panels connected to the bottom panel at opposing lateral peripheral edges and folded upward relative to the bottom panel, first and second end portions located at opposing longitudinal ends of the blank, each end portion including:

an inner end panel connected to a longitudinal peripheral edge of the bottom panel;

an outer end panel having an inner longitudinal edge connected to an outer longitudinal edge of the inner end panel at hinge portions;

first and second corner panels, each corner panel including inner longitudinal and lateral edges connected to respective edges of a side panel and the inner end panel, each corner panel folded about a diagonal gusset fold line to define a gusset, and each gusset including an edge portion defining a first locking feature for maintaining a respective gusset in a predetermined position adjacent to the inner panel;

a second locking feature defined in the outer end panel for maintaining the outer end panel in a predetermined position adjacent to the gussets and the inner end panel, wherein the second locking feature comprises first and second locking tabs, each locking tab defined by a lateral tab separation line located longitudinally inward from an outer longitudinal edge of the outer end panel and extending laterally to define a free tab end;

wherein the free tab ends are positioned between a respective gusset and the inner end panel to retain the outer end panel in position over the gussets; and wherein the outer end panel is folded about the hinge portions to overlapping relationship with at least a portion of each of the gussets to engage the first locking feature, and the second locking feature is positioned in cooperating engagement with the gussets.

14. The container as set forth in claim 13, wherein the first locking feature comprises a notch area defined on an upper edge of each gusset.

15. The container as set forth in claim 14, wherein the notch area defined in the upper edge of each gusset is engaged by a respective hinge portion.

16. The container as set forth in claim 15, wherein the notch areas engaged by respective hinge portions are located below upper edges of respective gussets, and the hinge portions extend below an upper edge of the container defined by the outer longitudinal edge of the inner end panel.

17. The container as set forth in claim 15, wherein a length dimension of each notch area, extending parallel to the upper edge of a respective gusset, is greater than a length dimension of a respective hinge portion engaged in the notch area.

18. The container as set forth in claim 13, including a longitudinal tab separation line extending longitudinally inward from the outer longitudinal edge of the outer end panel to each of the lateral tab separation lines, wherein the free ends of the tabs are defined at the longitudinal tab separation lines.

* * * * *